US006336631B1

(12) United States Patent
Volkert

(10) Patent No.: US 6,336,631 B1
(45) Date of Patent: Jan. 8, 2002

(54) TWO-SIDED PUZZLE

(76) Inventor: John K. Volkert, P.O. Box 8060, Wilmette, IL (US) 60091-8060

( * ) Notice: Subject to any disclaimer, the term of this patent is extended or adjusted under 35 U.S.C. 154(b) by 0 days.

(21) Appl. No.: 09/611,565

(22) Filed: Jul. 7, 2000

Related U.S. Application Data

(60) Provisional application No. 60/143,140, filed on Jul. 8, 1999.

(51) Int. Cl.[7] ..... A63F 9/10
(52) U.S. Cl. ..... 273/157 R; 273/157 A
(58) Field of Search ..... 273/157 R, 157 A, 273/153 R, 156

(56) References Cited

U.S. PATENT DOCUMENTS

| | | | | |
|---|---|---|---|---|
| 1,217,632 A | | 2/1917 | Pritchard | |
| 2,010,830 A | * | 8/1935 | Staudte | 273/157 R |
| 2,022,319 A | | 11/1935 | Meyercord | 273/157 R |
| 2,353,037 A | | 7/1944 | Irwin | 273/157 R |
| 2,984,489 A | | 5/1961 | Parlato | 273/157 R |
| 3,433,485 A | | 3/1969 | Renn et al. | 273/157 R |
| 3,923,307 A | | 12/1975 | Sukys et al. | 273/157 R |
| 4,336,664 A | | 6/1982 | Penick et al. | |
| 4,486,018 A | * | 12/1984 | Keller, Jr. | 273/157 R |
| 4,984,798 A | * | 1/1991 | Silberstein | 273/157 R |
| 5,156,698 A | * | 10/1992 | Roberts | 273/157 A |
| 5,232,088 A | * | 8/1993 | Leondidis | 273/157 R |
| 5,368,301 A | * | 11/1994 | Mitchell | 273/157 R |

* cited by examiner

*Primary Examiner*—Steven Wong
(74) *Attorney, Agent, or Firm*—Fitch, Even, Tabin & Flannery

(57) ABSTRACT

An assortment of two-sided puzzles are illustrated which are particularly suitable for use as promotional vehicles, postcards and game or novelty items. One embodiment employs a transparent backing sheet to which a set of puzzle pieces are attached by pressure-sensitive adhesive to one surface which set can be reassembled in a frame region to display a hidden promotional message. A postcard embodiment uses a similar transparent backing sheet to create a novelty piece wherein a plurality of interfitting pieces can be rearranged through the use of pressure-sensitive adhesive backings to either unscramble a message or uncover a scrambled visual pictorial. Another embodiment prints both sides of two sheets that are then laminated together via pressure-sensitive adhesive to create a lamination that contains a pair of puzzles that are solved through the use of a visage that only becomes exposed to view once a set of die-cut puzzle pieces is removed.

17 Claims, 4 Drawing Sheets

TWO-SIDED PUZZLE

This application claims priority from provisional application Ser. No. 60/143,140 filed Jul. 8, 1999, the disclosure of which is incorporated herein by reference.

The present invention relates to items which include a puzzle where the puzzle pieces adhere via pressure sensitive adhesive to a backing sheet. More particularly, the invention relates to two-sided puzzles of this type that are designed to be sent to an ultimate recipient; such puzzles might carry a scrambled message or a visual display. As such, they might be used for advertising or promotional materials or sold as novel postcards or the like.

BACKGROUND OF THE INVENTION

Sophisticated jigsaw puzzles have previously been marketed in which many of the pieces are of the same size and shape so as the person "making" or assembling the puzzle is often required to rely only upon the portion of the picture carried by the front face of the individual puzzle piece to assess whether it is in the right position to complete the pictorial display.

The concept of interchangeable pieces has also been used in simpler puzzles designed for promotional or advertising purposes or the like where a pictorial display, that may or may not also include a written message, is supplied to a recipient in a scrambled form in order to induce the curious recipient to rearrange the pieces to solve the puzzle and in this manner be exposed to the message. An example of such promotional puzzles is found in U.S. Pat. No. 4,336,664 (1982). This patent illustrates a label that is made of a lamination of two sheets held together by pressure-sensitive adhesive wherein a puzzle in scrambled form is printed in a circular frame region on the front sheet. The frame is divided into three identical regions of seven puzzle pieces each, with the shape of each piece in one region being different but with each piece in the region having two counterparts, one in each of the other regions. To facilitate solving the puzzle, a separate circular frame is provided on another section of the label. The puzzle piece, when removed from its original orientation, carries pressure-sensitive adhesive on its rear surface and can then be immediately placed onto the adjacent frame having the hopefully correct orientation as a step in solving the puzzle.

Such types of novel items that can be used for advertising and promotional purposes have proved popular, and there has been interest in providing improvements in this general theme. Accordingly, efforts have been made to develop other designs of relatively simple puzzles that can use pressure-sensitive adhesive to advantage in a novel item of this general character.

SUMMARY OF THE INVENTION

The invention associates a transparent backing sheet with a multi-piece puzzle wherein both faces of the puzzle pieces are utilized. Two-sided puzzle items of this general type are designed to be sent to recipients, e.g. as advertising material or simply postcards, and may include a transparent backing sheet having a frame region wherein a set of puzzle pieces are positioned. The puzzle pieces interfit with one another so as to substantially fill the frame region, and at least some of them are identical in size and shape. Pressure-sensitive adhesive is used to detachably adhere the set of pieces to the front surface of the backing sheet. The front faces of the set of puzzle pieces may be substantially blank, may contain a composite pictorial display or may contain a composite message, whereas the rear faces contain either a different composite message or a different composite pictorial display. When the puzzle item is distributed to the ultimate recipient, the set of puzzle pieces is arranged so that at least one of the sets of front and rear puzzle piece faces is scrambled and thus not comprehensible.

The nature of the item is such that the puzzle pieces can be removed one-by-one and reassembled, preferably on the rear surface of the backing sheet, by the recipient, who may be guided in achieving such reassembly by the representations on the front faces of the pieces. For example, the front faces may have a scrambled pictorial display that is then assembled in the manner of the usual jigsaw puzzle. Alternatively, each of the pieces may contain indicia on its front face which would direct the recipient to place the piece at a specific correspondingly shaped location on the rear surface of the backing sheet in the region of the frame. Once the reassembly of the pieces is completed, the message or pictorial display printed on the rear faces of the pieces has become comprehensible, and it can be viewed through the transparent backing sheet.

In one preferred embodiment considered to be particularly suited for advertising and promotional purposes, or alternatively for use as a game, the front faces of the set of puzzle pieces may have a pictorial display printed thereon, whereas the rear faces thereof contain an advertising or promotional message. In the initial orientation in which the item is distributed, both sets of puzzle piece faces are scrambled. When the pieces are reassembled so that the pictorial display on the front faces becomes comprehensible, the message on the rear faces is also comprehensible and is viewed through the transparent backing sheet.

In another preferred embodiment, the novelty item is created to be sold as a postcard, with the rear faces of the pieces containing an attractive picture of a local landmark or the like in scrambled condition. The front faces may provide a large blank space so as to facilitate the writing of a short greeting and message to the recipient. After the recipient reads the message and reassembles the pieces, perhaps guided by indicia printed in a corner of the front face of each piece, the rear faces of the pieces have now become assembled into the correct orientation so that the local landmark is now visible through the transparent backing sheet. In another alternative, the front faces may contain a printed message related to the geographical area plus space to write a brief message, and the pictorial display on the rear faces may become unscrambled. After adding the message to the kiss-cut pieces, the sender removes all of the pieces and replaces them in scrambled orientation. The card would contain a direction telling the recipient to unscramble the puzzle pieces in order to read the message.

In still another preferred embodiment, a two-sided puzzle item is provided which comprises first and second sheets both of which are printed on their front and rear surfaces. The two sheets are joined together in a face-to-face lamination wherein the inside surfaces are attached to each other by adhesive which includes at least a major region of pressure sensitive adhesive. A set of interfitting puzzle pieces is die-cut in adjacent sections of each of the sheets, which puzzle pieces are detachably attached to the inside surface of the other sheet in a first scrambled orientation, with at least some of said puzzle pieces being identical in size and shape. The set of scrambled puzzle pieces die-cut from the first sheet is originally positioned upon and attached to a printed section of the inside surface of the second sheet that contains a first visage, while the set of scrambled puzzle pieces die-cut in the second sheet is originally positioned upon and attached to a printed section of the second sheet that contains a second visage. The scrambled pieces can be removed so as to expose each of the first and second visages and then reassembled upon the respective outside surfaces of the sheets by attachment via the pressure-sensitive adhesive so as to respectively either complete or complement both of the visages.

DETAILED DESCRIPTION OF THE PREFERRED EMBODIMENTS

Figure 1:
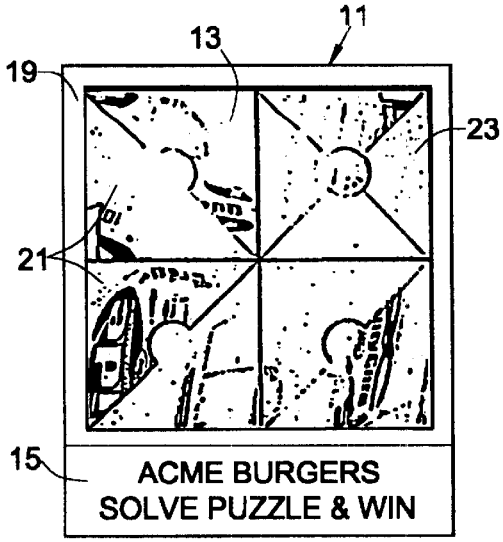
FIG. 1 is a front view of an item embodying various features of the invention wherein a plurality of puzzle pieces are arranged in scrambled condition on the front surface of a transparent backing sheet.

FIG. 1 illustrates an item 11 which may be used for promotions or advertising and which is rectangular in shape and includes an upper region 13 that serves as a frame for a pictorial display or the like and a lower separate section 15 that provides space for a promotional message or the like. By frame or frame region is meant the definition of a specific area in which the interfitting puzzle pieces will be reassembled. The item 11 is a lamination of a transparent backing sheet 17 (FIG. 3) and an opaque main sheet 19 that is printed on both sides. The rear surface of the main sheet 19 is laminated to the front surface of the backing sheet 17 by clear pressure-sensitive adhesive. Prior to lamination, either one of the two surfaces is coated with a release coating, e.g. a silicone of the usual character well known in this art, so that the pressure-sensitive adhesive will adhere preferentially to the other surface. The two options are explained hereinafter. Following lamination of the printed main sheet 19 and the backing sheet 17, a kiss-cutting operation is carried out, as well known in this art, in order to create a plurality of interfitting puzzle pieces 21 in the frame section 13 of the sheet.

Figure 2:
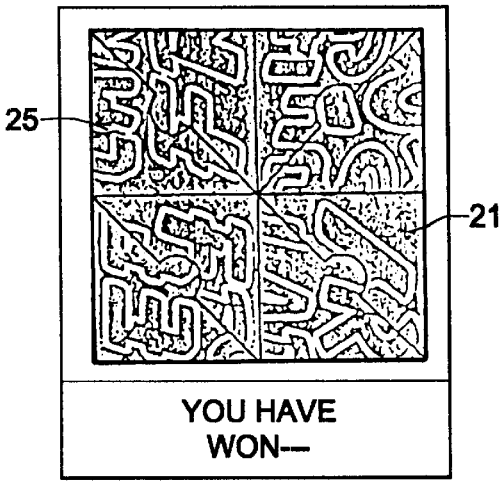
FIG. 2 is a rear view of the item of FIG. 1 which illustrates how the item appears from the rear when viewed through the transparent ba cking sheet.

In the illustrated embodiment, the sheet 19 is printed so that the puzzle pieces are arranged in a scrambled condition so the pictorial display is incomprehensible. As can be seen from FIG. 2, the rear surfaces 25 of the puzzle pieces 21 are printed with a written message which is likewise present in scrambled condition.

Figure 3:
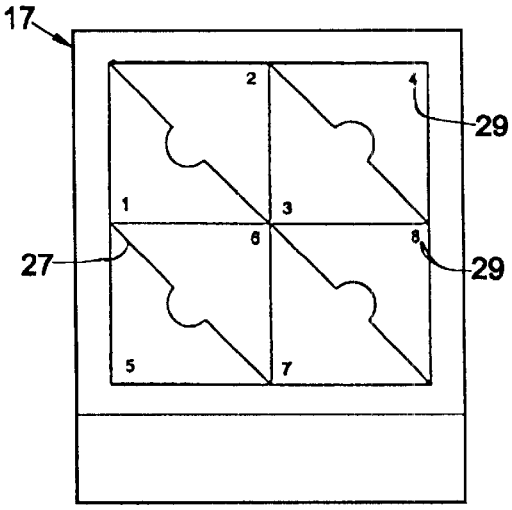
FIG. 3 is a view of the transparent backing sheet from the rear which illustrates the markings that delineate locations where correspondingly marked puzzle pieces should be placed in order to correctly solve the puzzle.

As best seen in FIG. 3, if desired, the transparent backing sheet 17 can be printed with a grid 27 to assist the recipient in reassembling the puzzle pieces 21 with the correct orientation. As a further option, the grid can include indicia 29, such as numbers or letters, that would correspond to numbers or letters printed on the puzzle pieces 21 that would direct the recipient to place a particular puzzle piece in the correct location in order to easily solve the puzzle. The item 11 may be used as a game, but is designed particularly for use as an advertising or promotional item which would usually include the name of the vendor on the front surface of the main sheet 19, in this instance, in the lower section 15, which may likewise contain a direction such as "Solve puzzle and win".

Figure 4:
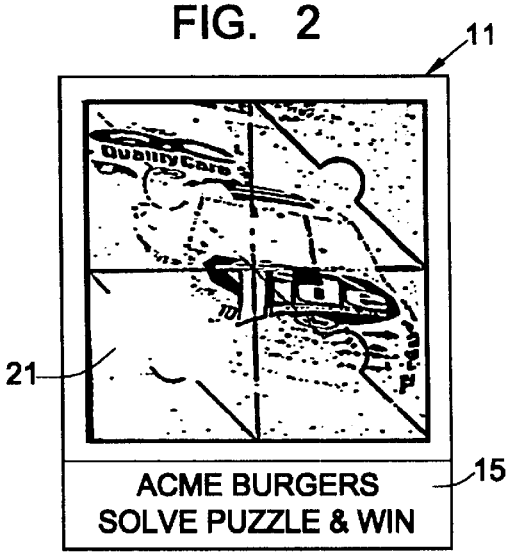
FIG. 4 is a view similar to FIG. 1 showing the puzzle pieces rearranged so that the pictorial display becomes comprehensible.
Figure 5:
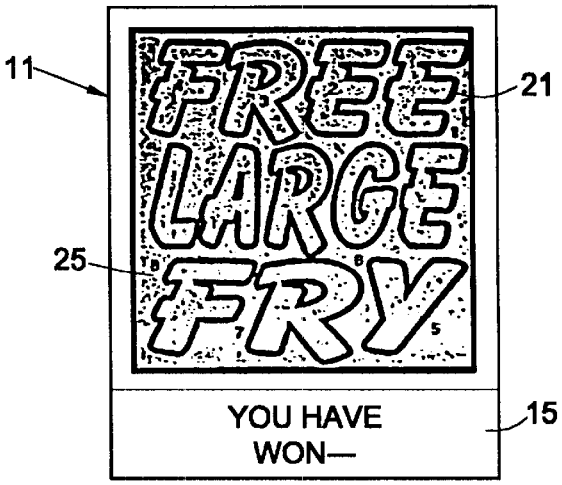
FIG. 5 is a view similar to FIG. 2 which shows the scrambled message of FIG. 2 in comprehensible form.

The recipient of the promotional item would then remove the eight puzzle pieces from the front surface of the transparent backing sheet 17 and then individually rearrange them to create a comprehensible visual display in unscrambled condition. Such is depicted in FIG. 4 where the display is one of a race car. The printing of the front side and the rear side of the main sheet 19 is such that, when the puzzle pieces 21 have been reassembled so that the front surfaces provide the comprehensible visual display, the message carried by the rear surfaces of the puzzle pieces is also assembled in comprehensible manner, as shown in FIG. 5. The rear surface of the lower portion 15 of the main sheet could be fitted with a suitable explanatory legend such as "You have won" with the sentence being completed by the unscrambled message on the rear surfaces of the puzzle pieces 21.

In the instance where the rear surface of the puzzle pieces 21 is coated with a release coating, the clear pressure-sensitive adhesive will adhere to the front surface of the transparent backing sheet 17 and accordingly in reassembling the pieces to create the comprehensible pictorial display, the puzzle pieces will be returned and placed on the front surface of the backing sheet 17 in the correct orientation. Once the reassembly is complete, because the backing sheet 17 is transparent, the recipient would turn the item over and would view the message informing him or her the prize that had been won. As an alternative, the rear surface of the backing sheet 17 could also be coated with pressure-sensitive adhesive in the region of the frame and covered with a release liner that could be clear or opaque and optionally printed. The recipient could then be instructed to remove the pieces, switch the release liner from rear to front, and carry out the reassembly on the rear surface.

If instead the front surface of the transparent backing sheet 17 was coated with the release coating, the pressure-sensitive adhesive would adhere to the rear surfaces of the puzzle pieces 21 and, if desired, they could again be reassembled on the front surface in the same manner as previously indicated. However, the pieces 21 could be removed one by one and applied one by one to the rear surface of the transparent backing sheet 17 if desired in this situation so that only one puzzle piece need be separated from the item at a time, thus perhaps simplifying the reassembly. Moreover, in order to further simplify the task, indicia 29, i.e. the numbers 1–8, could be applied to the rear surfaces of the puzzle pieces 21 to assist the recipient in the reassembly of the puzzle. In such a situation instead of having to rely upon the pictorial display, the recipient could simply match the number on the rear surface 25 of a puzzle piece with the indicia 29 on the grid and place the piece in that location. Under such circumstances, the pictorial display would now appear in its comprehensible arrangement on the rear surface of the transparent backing sheet and by turning the piece over the prize that had been won would be known by reading the now comprehensible message through the front surface of the transparent backing sheet.

As a further option, if desired in order to provide still further area for advertising or promotional text, the transparent backing sheet 17 might be made either twice as wide or twice as high, with the printed grid 27 being located either alongside or above or below the frame region 13 of the main sheet. In such an instance, the release coating would be applied to the transparent sheet so that the pressure-sensitive adhesive would adhere to the rear surface of the puzzle pieces 21. The recipient could then reassemble the puzzle, as for example, next to the original frame on the grid that is provided to create the comprehensible pictorial display. Again, simply turning the item over would allow the recipient to read the message which would indicate what prize had been won.

Figure 6:
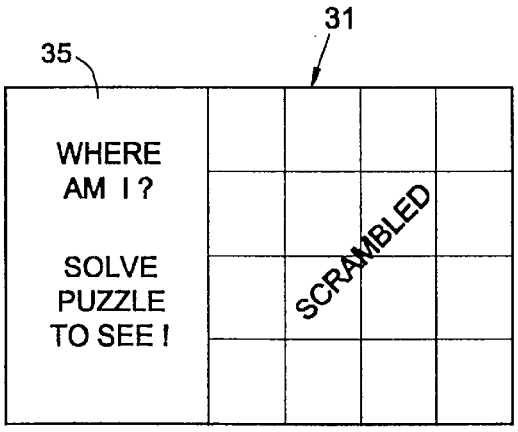
FIG. 6 is a front view, similar to FIG. 1, of an alternative item embodying various features of the invention designed in the form of a postcard to be sent through the mail.
Figure 7:
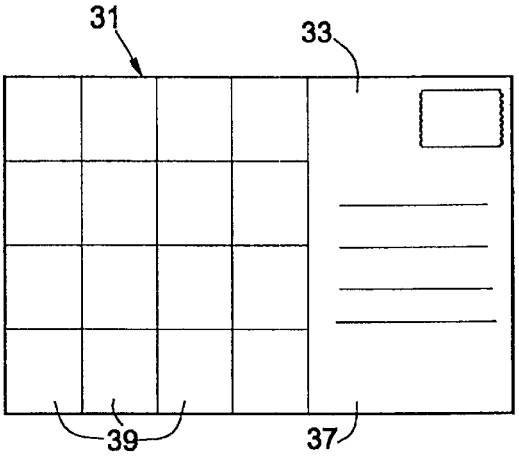
FIG. 7 is a rear view of the item shown in FIG. 6.
Figure 8:
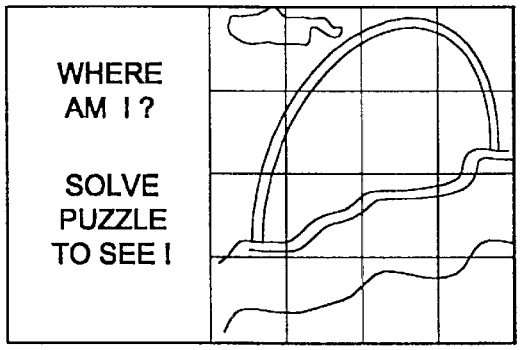
FIG. 8 is a view similar to FIG. 6 with the puzzle pieces rearranged so the pictorial visage is comprehensible.

Illustrated in FIGS. 6–8 is an alternative embodiment of a novelty item of this general type in the form of a postcard 31. Again, the item consists of an opaque sheet 33 that is printed on both surfaces that is laminated by pressure-sensitive adhesive to a transparent backing sheet 35 of the same dimension. What is arbitrarily referred to as the front surface 37 of the opaque sheet 33 includes a right-hand section similar to what is found on the usual postcard with a space upon which to write the name and address of the recipient and affix the appropriate postage. The left-hand section of the main sheet is die-cut into a plurality, e.g. 16, total pieces 39.

The rear surface of the printed main sheet 33 is visible (see FIG. 6) through the transparent backing sheet 35. On the rear surface of the address portion of the sheet, a suitable legend such as "Where am I? Solve puzzle to see!" is printed. To the immediate right thereof might appear the scrambled pictorial visage representative of a particular city, area, monument, national park, etc. in the geographic region where the novelty postcards 31 would normally be sold. For example, the illustrated design is one of the well known arch on the riverfront of St. Louis which served as the gateway to the West in the $19^{th}$ Century.

The purchaser of the card could then pen his greetings on the kiss-cut portion of the front surface 37 of the main sheet 33, add the name and address of the recipient and mail the card with appropriate postage. Upon receipt, the recipient would remove the sixteen puzzle pieces 39, after reading the message, and reassemble them so that the rear surfaces of the puzzle pieces 39 on which the pictorial display is printed would be in comprehensible orientation, as shown in FIG. 8.

If the pressure-sensitive adhesive and release coating were applied so the adhesive remains adhered to the rear surfaces of the puzzle pieces 39, then reassembly could be carried out while viewing the pictorial display through the transparent backing sheet, reapplying the pieces 39 either onto the front surface or the rear surface of the backing sheet. Alternatively, if the release coating was applied to the rear surface of the main sheet 33, then the pressure-sensitive adhesive would remain attached to the transparent backing sheet and the reassembly might be more simply be carried out on the front surface from which the pieces 39 were removed, so as to create the pictorial display in the region next to the name and address of the recipient where the original greeting appeared. As a still further alternative, indicia, such as small numbers or letters similar to the indicia 29, could be printed on a grid on the transparent backing sheet 35, and corresponding small numbers could be printed so that they would appear in corners of the sixteen die-cut square pieces 39 on which the purchaser would write his or her greeting or message. In this case, all sixteen puzzle pieces 39 could be removed and then reassembled in the orientation dictated by the corresponding indicia to again fill up all sixteen squares. Following such reassembly, the recipient would turn the postcard over and would see the intended pictorial visage through the transparent backing sheet 35, as shown in FIG. 8.

Figure 9:
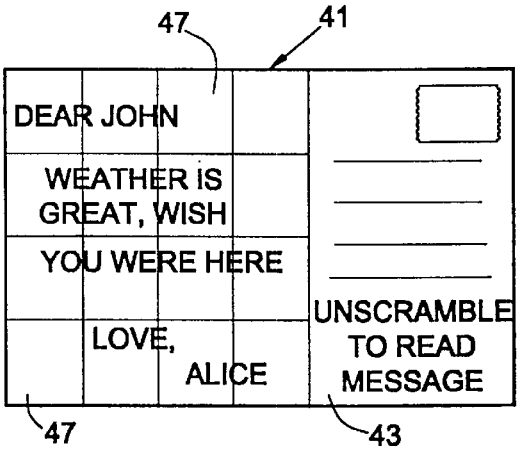
FIGS. 9 and 10 are front and rear views of an alternative embodiment of an item similar to that of FIG. 6 where the item is originally printed with the pictorial visage on the front of the card in unscrambled condition, with FIG. 9 carrying an exemplary message written by the sender.
Figure 10:
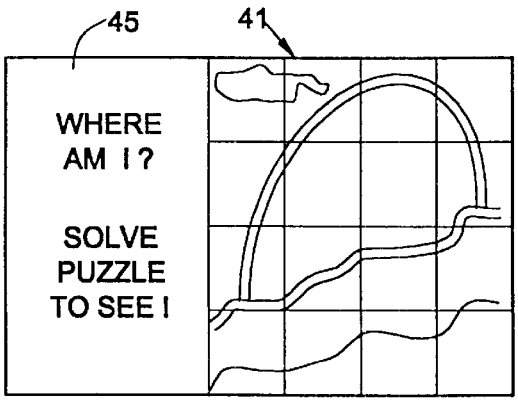
Figure 11:
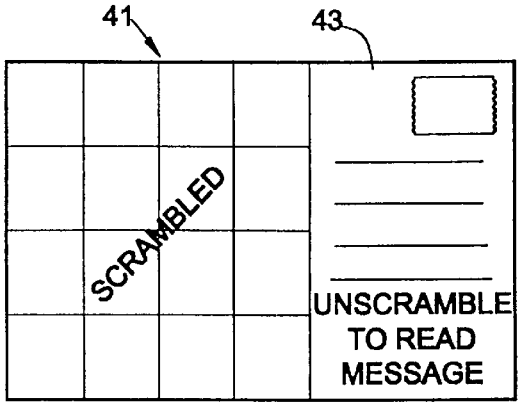
FIG. 11 is a view of the rear of the item of FIG. 9 showing the scrambled message after the sender has written the message and then removed and replaced all of the puzzle pieces to scramble both the pictorial display and the message.

Illustrated in FIGS. 9–11 is an alternative embodiment of a novelty postcard 41 which consists of a similar main sheet 43 that is printed on both sides and laminated to a transparent backing sheet 45 that is essentially the same as the sheet 35. However, in this embodiment, in its original form, the pictorial visage is printed in its unscrambled condition, as seen in FIG. 10. Following lamination, the card 41 is kiss-cut so as to create a plurality of puzzle pieces 47 in the region to the left of the address portion of the main sheet 43. As a result, when the purchaser buys the card, he can view the pictorial visage which again is the St. Louis Arch (see FIG. 10).

After the purchaser writes the desired message on the die-cut front surfaces of the puzzle pieces 47, all sixteen of the puzzle pieces are removed and then arbitrarily scrambled and returned to the card as illustrated for example in FIG. 11. Some of the pieces may be upside down and others rotated 90° in either direction, thus rendering the message incomprehensible, and of course likewise rendering the pictorial visage incomprehensible. Under these circumstances, when the recipient receives the card and notes the legend below the address, such as "Unscramble to read message", he will then reassemble the sixteen puzzle pieces in the correct orientation in order to read the message as it was written in FIG. 9. In so doing, the pictorial visage will be returned to its original comprehensible orientation, so the recipient can see the view which is representative of the geographical location from which the postcard was mailed.

Figure 14:
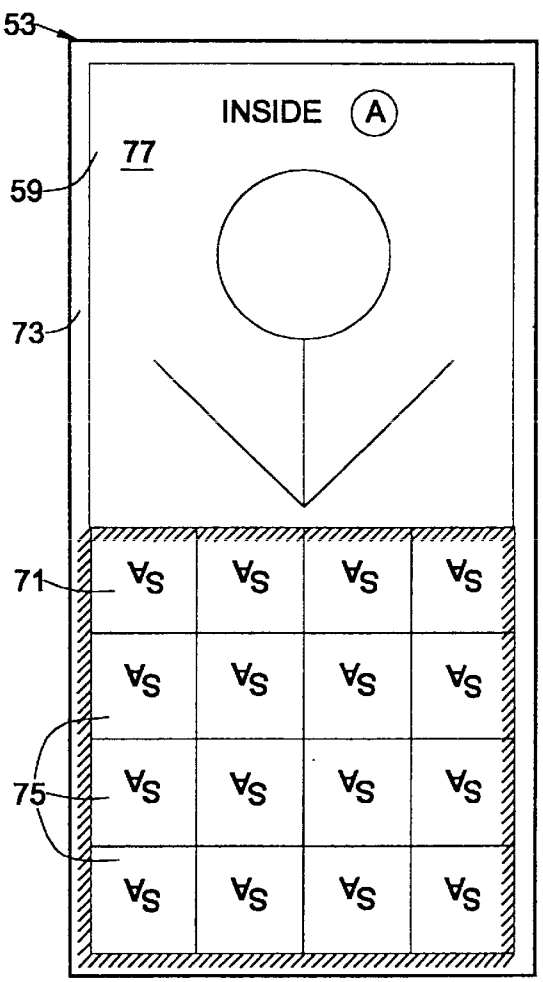
FIGS. 12–15 are views of the front and rear surfaces of two sheets which are printed on both front and rear surfaces and which are intended to be laminated to each other, with FIGS. 13 and 14 representing the two inside surfaces that will be in face-to-face contact in such lamination which provides a double puzzle arrangement embodying various features of the invention.
Figure 13:
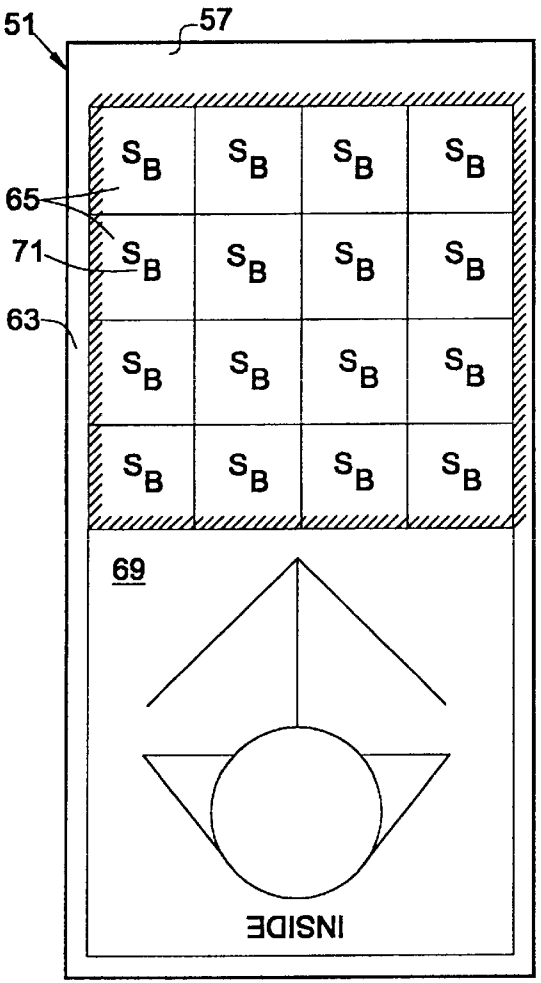
Figure 12:
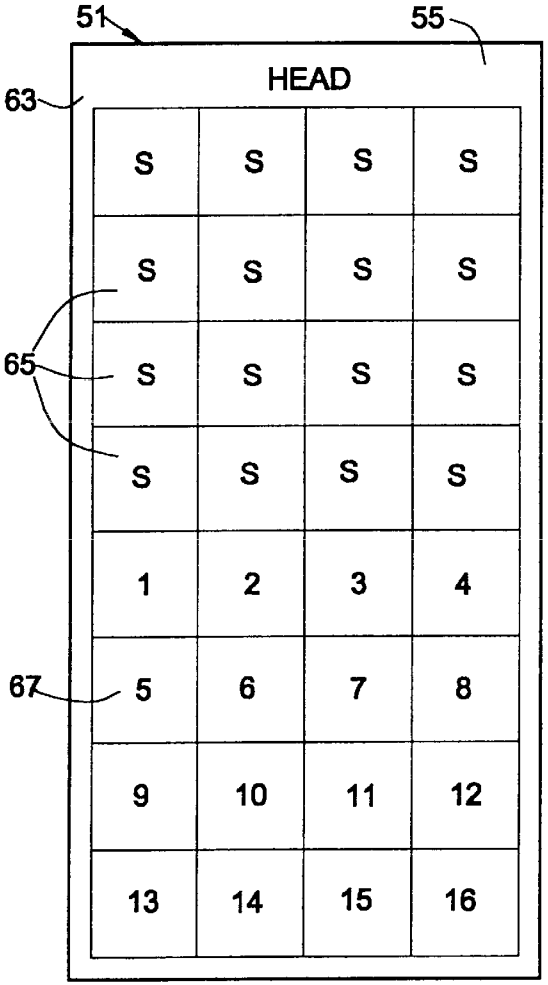
Figure 15:
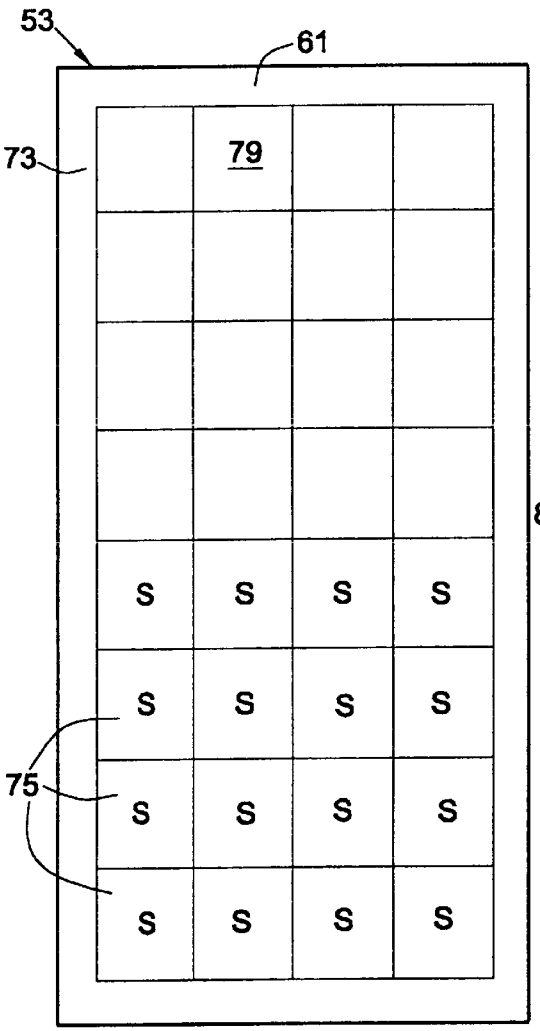

Shown in FIGS. 12–15 are the front and rear surfaces of two sheets of the same rectangular size which are both printed on their front and rear surfaces and which are designed to be laminated to each other to create a double puzzle arrangement. The sheets are referred to as a first sheet 51 and a second sheet 53. Rather than to refer to the surfaces as the front and rear surfaces, in the context of this overall arrangement, it appears simpler to refer to the surfaces in the orientation in which they will assume in the laminated item. Therefore, FIG. 12 depicts what will be referred to as the outside surface 55 of the first sheet, and FIG. 13 depicts the inside surface 57 of the first sheet 51. Similarly, FIG. 14 depicts the inside surface 59 of the second sheet, whereas FIG. 15 depicts the outside surface 61 thereof.

Referring first to FIG. 12, the outside surface 55 of sheet 51 includes a perimeter frame 63 which surrounds 16 die-cut puzzle pieces 65 that are located in an upper rectangular region and an uncut or imperforate lower region 67 which serves as a platform section and lies within the bounds of the perimeter frame. The platform region 67 is optionally printed with a grid or other guide so as to facilitate the reassembly of the puzzle pieces 65 onto this platform section. In addition, the 16 rectangular boxes can be optionally numbered (as depicted) to further guide the recipient of the item in reassembly thereof, should such guidance be desired.

FIG. 13 shows the inside surface 57 of the first sheet 51; this surface consists of the perimeter frame 63, the rear surfaces of the puzzle pieces 65 (which can be optionally numbered to coincide with the numbers on section 67), and a lower rectangular region which is printed with an incomplete first visage 69 and which constitutes the opposite surface of the platform section 67. The 16 puzzle pieces carry a pressure-sensitive adhesive 71; such is depicted by a speckled or dotted pattern in FIG. 13. This pressure-sensitive adhesive, that is used to laminate the two sheets 51 and 53, preferentially adheres to the rear surfaces of the puzzle pieces 65. Consistent therewith, it should be understood that the portion of the inside surface of the first sheet that constitutes the incomplete first visage 69 would be coated with a release coating of silicone or the like so that the pressure-sensitive adhesive applied in this region to complete the lamination would release therefrom and adhere to a second set of puzzle pieces to be described hereinafter.

Referring now to FIG. 14 where the inside surface 59 of the second sheet 53 is depicted, it can be seen that it has the same pattern as the inside surface 57 of the first sheet with the exception of being inverted. More specifically, the second sheet 53 contains a perimeter frame 73 and a second set of die-cut puzzle pieces 75 that are located within that perimeter frame in a rectangular region which constitutes the bottom one-half of the interior surface. The upper half of the sheet contains a printed second incomplete visage 77. The inside surfaces of the die-cut puzzle pieces 75 are similarly covered with a speckled or dotted pattern to represent the pressure-sensitive adhesive 71 which coats these surfaces of the puzzle pieces in the lamination. The surface of the second visage 77, similar to the first visage 69, is coated with a release coating.

Finally referring to FIG. 15, the outside surface 61 of the second sheet 53 can be seen to include the perimeter frame 73, the 16 scrambled puzzle pieces 75 and an upper region 79 (which is the opposite surface of the second incomplete visage 77). This upper region 79 serves as a platform for attachment of the puzzle pieces 75, and it can be optionally provided with a grid or other guide means to facilitate appropriate alignment of the pieces during their reassembly.

In fabricating the double puzzle item, the two printed sheets 51, 53 would first be initially coated with a silicone or other release coating in the regions of the first visage 69 and the second visage 77. Lamination might then take place simply by totally coating one of the sheets with pressure-sensitive adhesive (PSA) and then aligning and pressing the two sheets together under pressure to effect overall joinder. Alternatively, the perimeter frame portions 63, 73 of the sheets could be permanently joined, as by applying a high strength permanent adhesive to one of the frames and PSA to the remainder of the sheet, so as to unite the two sheets in the perimeter regions and thus give overall stability to the laminated item. Of course, depending upon the width of the legs of the frames 63, 73, attachment by pressure-sensitive adhesive may provide adequate rigidity and thus negate the need to differentially coat the sheet material with different adhesive patterns.

Once the lamination has been effected so that the first and second sheets 51, 53 are joined in face-to-face alignment to each other, the lamination is subjected to kiss-cutting as explained hereinbefore with respect to the item 11. A first kiss-cutting operation would preferentially die-cut the first sheet to form the 16 puzzle pieces 65 at the location within the bounds of the perimeter frame 63. A second kiss-cutting operation would die-cut the second sheet 53 to form the 16 puzzle pieces 75. Using more sophisticated equipment, it may be possible to carry out the two kiss-cutting operations simultaneously, as for example while running the laminated sheet material, in web form, in a direction aligned with the shorter dimension of the individual sheets.

If desired, directions or explanations with regard to the two-puzzle item could be suitably imprinted on the perimeter frames of the outside surfaces of either both of sheets 51, 53, or such could be imprinted within the two platform regions 67, 79 which will be initially in full view, but ultimately become obscured upon reassembly of the scrambled puzzle pieces.

When one views the laminated item, looking at the outside surface 55 of the first sheet 51, it will be understood that, immediately thereunder and facing in the same direction, will be the inside surface 59 of the second sheet 53, which is shown in FIG. 14. Thus, it can be seen that, when the 16 interfitting puzzle pieces 65 are removed, the second incomplete visage 77 will be exposed, coming into full view to the recipient. In its simplest form, the recipient of the laminated item will be directed to reassemble the 16 interfitting puzzle pieces 65 in appropriate alignment and orientation on the rectangular platform section 67, which is located immediately below the second visage 77 that appears in the laminated item when the pieces 65 are removed. As previously indicated, the pressure-sensitive adhesive 71 that is used to laminate the two sheets preferentially adheres to the surfaces of the die-cut puzzle pieces because of the release coating that was applied to the areas of the first and second incomplete visages. The grid system imprinted in the platform region 67 assists the recipient in the alignment of the individual pieces and permits the recipient to complete the first puzzle by rearranging the adhesive-carrying pieces into proper orientation thereof in the platform region 67 on the outside surface of the first sheet so as to form a complete visage.

Once the first puzzle is complete, the recipient would flip the item over 1800 so as to view the surface depicted in FIG. 15, i.e. the outside surface 61 of the second sheet 53 which is known to be laminated atop of the inside surface 57 of the sheet 51, that is depicted in FIG. 13. Thus, it will be understood that the first incomplete visage 69 lies immediately below the 16 die-cut puzzle pieces 75. The recipient may then wish to invert the item head to foot so as to locate the puzzle pieces 75 in the upper region of the frame 73 and then remove those 16 puzzle pieces as done previously, exposing the incomplete first visage 69. The pieces 75 that would then be reassembled, as explained hereinbefore, in the platform section 79, which is also shown to have a printed grid to assist in proper alignment of the pieces, to complete the visage. It should be understood that completing an incomplete visage is only exemplary, and alternatively two complementary visages could be used, each of which might be complete in itself.

As previously mentioned, if desired, the scrambled pieces could be printed with a small identifier on the front, or preferably on the rear surface thereof that could be seen through clear pressure-sensitive adhesive, which identifier would direct the recipient to which of the numbered boxes in the grid that particular puzzle piece should be placed and attached. In a promotional item, such assistance to the recipient might be felt to be warranted. On the other hand, if it were desired to make solution of the two puzzles even more difficult, the sheets 51 and 53 could be printed so that some of the puzzle pieces 65 together with some of the other pieces 75 would be required to complete the second visage, while the remainder would be used to complete the first visage. By such a double scrambling of the pieces, a recipient might need to first remove all 32 pieces and then carefully examine both the first and second incomplete visages in order to determine how all 32 puzzle pieces should be reassembled in order to solve both of the puzzles.

Although the two puzzles are shown to be located vertically above and below each other, with the sheet being oriented with its longer dimension vertical, it should be understood that the die-cut puzzle pieces could instead be formed in either the right or left one-half of the region within the perimeter frame 63, so as to create a long narrow platform upon which reassembly would occur either to the right or left of the region from which the pieces were removed.

Figure 16:
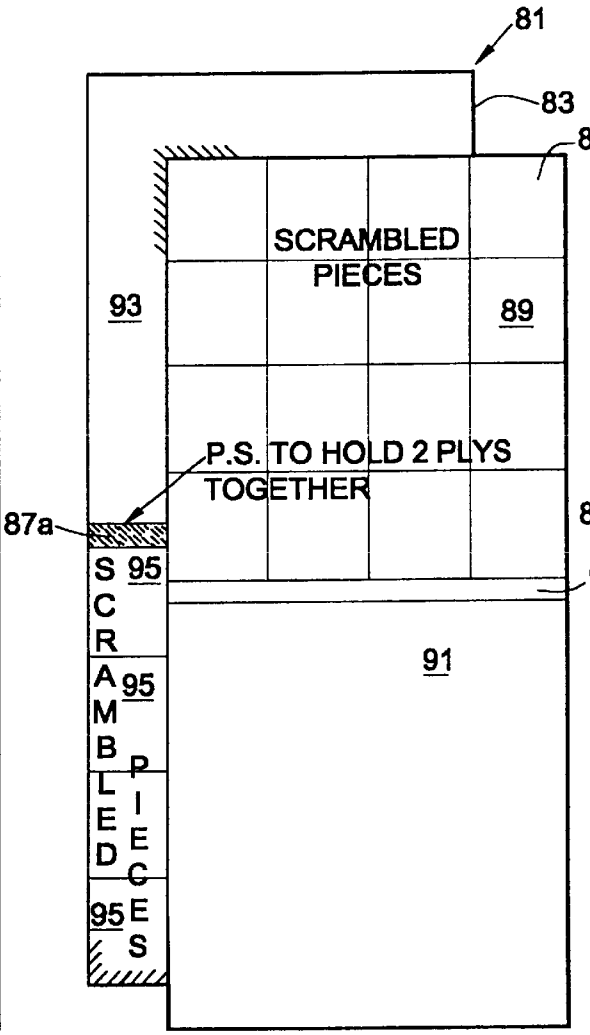
FIG. 16 is a schematic perspective view of an alternative embodiment of a double puzzle arrangement generally similar to that depicted in FIGS. 12–15.

Depicted schematically in FIG. 16 is an alternative embodiment of a double puzzle arrangement 81 where the perimeter frame is eliminated by printing first and second sheets 83, 85 so as to have a narrow central region 87, 87*a* extending across the sheet from edge to edge which narrow region would separate die-cut puzzle pieces 89 of the first sheet from a platform section 91 of the first sheet upon which these puzzle pieces might be reassembled as previously described. This narrow central region 87 of the first sheet would be aligned with a similar narrow central region 87*a* of the second sheet. They could be held together in the lamination either by an overall coating of pressure-sensitive adhesive or by a strip of permanent adhesive that could be laid down in this region on one of the two sheets which would secure the two sheets 83, 85 in a particularly stable condition. Except for the foregoing, the construction would be substantially the same as previously described. The narrow center region 87 could be simply left blank but would more appropriately be printed so as to simply continue the pattern of the visage 93 that will be uncovered by the removal of the puzzle pieces 89, or in a situation where the reassembled puzzle pieces are not a continuation of the first visage but one that is complementary thereto, the narrow center region 87 could be split so that the lower half of it would be an extension of the graphic representation resulting from the proper reassembly of the 16 puzzle pieces.

Figure 17:
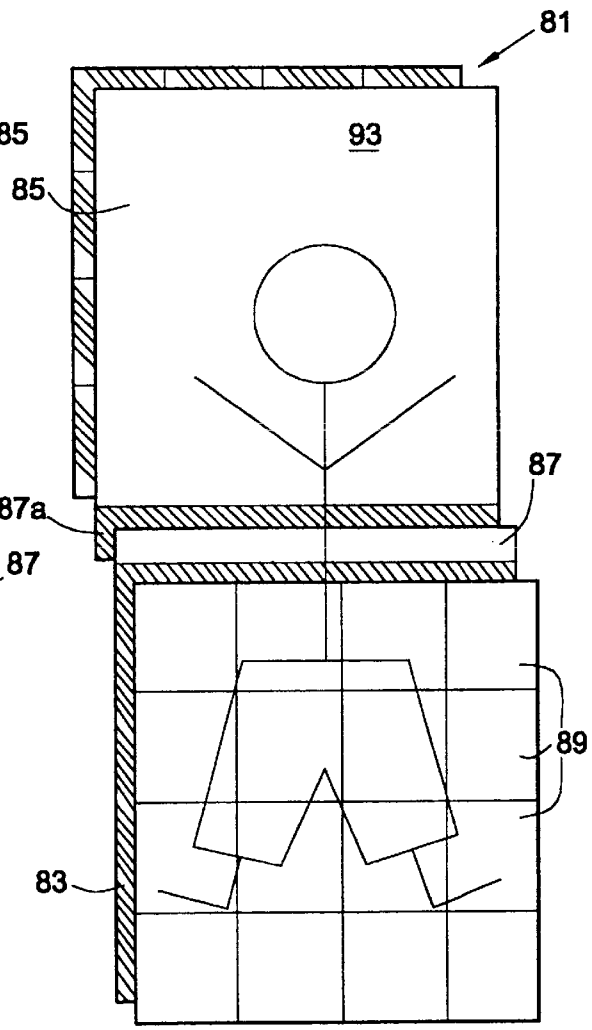
FIG. 17 is a perspective view of the FIG. 16 embodiment following unscrambling by the recipient.

Once the lamination was complete, kiss-cutting would be effected so as to die-cut the puzzle pieces 89 in essentially one-half of the first sheet 83 and puzzle pieces 95 in essentially the other half of the second sheet 85, with the die-cut pieces being printed in a scrambled orientation and being retained in such orientation by the pressure-sensitive adhesive that holds them to the first or second visage. The puzzles would be solved in the manner explained hereinbefore, and the item 81 bearing the two solved puzzles is depicted in FIG. 17.

Although the invention has only been described with regard to certain preferred embodiments, it should be understood that various changes and modifications as would be obvious to one having ordinary skill in this art may be made without deviating from the scope of the invention which is defined by the claims appended hereto. For example, the shapes of the puzzle pieces could be made much more complicated, employing shapes such as those found in the usual jigsaw puzzles and the like, for instance a pattern of five or six pieces might be repeated in two or three or more sections of the overall frame. The frame of course need not be square or rectangular but could be circular or have any desired shape so long as it is conducive to having groups of pieces of the same shape that can be scrambled while still filling the frame area. Instead of employing an overall coating of pressure-sensitive adhesive, a suitable pattern, e.g. striations, might be used. With respect to the promotional item 11, two or more puzzles might be provided in different frame regions, and optionally, to increase the difficulty and enjoyment, the pieces from the two puzzles may be printed so that they are mixed with each other.

Particular features of the invention are set forth in the claims that follow.

What is claimed is:

1. A two-sided puzzle item designed to be sent to a recipient, which item comprises:

a transparent backing sheet having front and rear surfaces which include a frame region wherein a set of puzzle pieces can be positioned, and a set of interfitting puzzle pieces detachably attached to said front surface in a first orientation and substantially filling said frame region, at least some of said pieces being identical in size and shape, said set of puzzle pieces having a set of front faces that contain a first visage, and having a set of rear faces that contain a second visage different from said first visage, said puzzle pieces in said first orientation being arranged so that at least one of said first and second visages is scrambled and is not comprehensible to the recipient, whereby said pieces can be reassembled in said frame region by the recipient to a second orientation by removal from and reattachment to said backing sheet, as a result of which reassembly said scrambled visage becomes comprehensible in said second orientation.

2. The item according to claim 1 wherein said pieces are attached by clear pressure sensitive adhesive which adheres to said front surface of said backing sheet and allows said pieces to be reassembled upon said front surface in said frame region.

3. The item according to claim 1 wherein said second visage is either a composite message or a composite pictorial display, and is scrambled in said first orientation, and wherein reassembly is guided by said front faces of said pieces and said comprehensible second visage is visible through said transparent backing sheet.

4. The item according to claim 1 wherein each of said plurality of puzzle pieces has clear pressure-sensitive adhesive adhering to the rear face thereof by means of which said pieces are attached to said front surface of said backing sheet in said first orientation and can be detached therefrom and reattached, either to said rear surface thereof or to said front surface thereof in said frame region in said second orientation.

5. The item according to claim 1 wherein said front faces of said pieces in said first orientation exhibit a scrambled pictorial display.

6. The item according to claim 1 wherein said front faces of said pieces in said first orientation exhibit an intelligible message.

7. The item according to claim 1 wherein said frame region includes markings of an appropriate shape to define the location where each puzzle piece of a specific size and shape is to be correctly located in said second orientation on said backing sheet.

8. The item according to claim 7 wherein said markings include indicia which match indicia included upon otherwise bland front faces.

9. The item according to claim 7 wherein said frame region includes a grid pattern which divides said frame region into a plurality of subregions, each of which is sized to accommodate a plurality of said interfitting puzzle pieces.

10. An advertising or promotional item or game comprising:

a transparent backing sheet having front and rear surfaces which generally include a frame region wherein a set of puzzle pieces can be positioned, and a set of interfitting puzzle pieces detachably attached to said-front surface in a first orientation and substantially filling said frame region, at least some of said pieces being identical in size and shape, said set of puzzle pieces having front faces which present a composite visual pictorial in unscrambled condition and having rear faces which-present a composite message in unscrambled condition, said puzzle pieces being arranged in scrambled fashion on said backing sheet in said first orientation so that both said pictorial display and said message are scrambled and neither is comprehensible, whereby said pieces can be reassembled on said backing sheet, as by attachment to said rear surface of said backing sheet, into a second unscrambled orientation wherein said front faces thereof correctly complete said composite pictorial display as a result of which said message on said rear faces thereof becomes comprehensible and is visible through said transparent backing sheet.

11. The item according to claim 10 wherein each of said plurality of puzzle pieces has clear pressure-sensitive adhesive adhering to the rear face thereof by means of which said pieces are attached to said front surface of said backing sheet, as a result of which each said piece can be detached therefrom and reattached to said rear surface thereof in said frame region.

12. The item according to claim 11 wherein said frame region includes markings of an appropriate shape to define the location where each puzzle piece of a specific size and shape is to be correctly located in said second orientation on said rear surface of said backing sheet.

13. The item according to claim 12 wherein said frame includes a grid pattern which divides said frame region into a plurality of subregions, each of which is sized to accommodate a plurality of said interfitting puzzle pieces.

14. A two-sided puzzle item, which item comprises:

first and second sheets both of which are printed on their front and rear surfaces, said sheets being joined together in a face-to-face lamination wherein inside surfaces of said printed sheets in such lamination are attached to each other by adhesive which includes at least a major region of pressure sensitive adhesive, and a set of interfitting puzzle pieces die-cut in adjacent sections of each of said first and second sheets, each set of puzzle pieces being detachably attached by said pressure-sensitive adhesive to said inside surface of said other sheet in a first scrambled orientation, with at least some of said puzzle pieces being identical in size and shape, said set of scrambled puzzle pieces die-cut from said first sheet being originally positioned upon and attached to a printed section of said inside surface of said second sheet that contains one first visage, said set of scrambled puzzle pieces die-cut in said second sheet being originally positioned upon and attached to a printed section of said second sheet that contains another visage, whereby said scrambled puzzle pieces can be removed so as to expose each of said visages and reassembled upon the respective outside surfaces of said first and second sheets by attachment via said pressure-sensitive adhesive, such reassembly being performed by placement of said puzzle pieces onto the opposite surfaces of said printed regions that contain said visages as a result of which both said visages on opposite surfaces of said item are either completed or complemented.

15. The item according to claim 14 wherein said pressure-sensitive adhesive adheres to said inside surfaces of said puzzle pieces and allows said pieces to be reassembled by easy attachment to said outside surface of one of said sheets which is printed with guide means to facilitate proper orientation.

16. The item according to claim 14 wherein each of said sheets includes a perimeter frame that at least partially surrounds said die-cut pieces and unites said two sheets in said die-cut lamination.

17. The item according to claim 14 wherein each of said sheets contains a narrow central region which lies between said respective set of die-cut puzzle pieces and said printed visage-containing region and wherein said two central regions are juxtaposed and adhesively attached to each other in such lamination.

* * * * *